United States Patent [19]

Holmberg

[11] 4,076,294

[45] Feb. 28, 1978

[54] IMPACT ABSORBING LOCK APPARATUS

[76] Inventor: Bradley C. Holmberg, 2628 30th Ave. South, Minneapolis, Minn. 55406

[21] Appl. No.: 602,827

[22] Filed: Aug. 7, 1975

[51] Int. Cl.[2] ..... E05C 21/00

[52] U.S. Cl. ..... 292/340; 292/341.17

[58] Field of Search ..... 292/340, 341.17, DIG. 44, 292/341.15, 262

[56] References Cited

U.S. PATENT DOCUMENTS

| | | | |
|---|---|---|---|
| 1,663,300 | 3/1928 | Halper | 292/341.17 |
| 1,676,515 | 7/1928 | Anstey | 292/78 |
| 2,389,056 | 11/1945 | Jamison, Jr. | 292/341.17 X |
| 2,473,205 | 6/1949 | Jazwieck | 292/341.17 |
| 3,338,612 | 8/1967 | Howard | 292/DIG. 44 |

FOREIGN PATENT DOCUMENTS

| | | | |
|---|---|---|---|
| 1,469,374 | 1/1967 | France | 292/341.17 |

*Primary Examiner*—Richard E. Moore

*Attorney, Agent, or Firm*—Williamson, Bains, Moore & Hansen

[57] ABSTRACT

An impact absorbing lock apparatus to prevent unauthorized entry through a door by kicking or ramming of the door comprises a mounting bracket attached to the door jamb of the door adjacent a latch bolt used to secure the door, a keeper for retaining the latch bolt and mounted for movement relative to the mounting bracket between a rest position contacting the mounting bracket and a displaced position, and a spring contacting the keeper and urging the keeper toward the rest position, the spring absorbing any impulse forces applied to the latch bolt and keeper and permitting keeper movement to displace the spring to absorb impulse forces and keep the lock apparatus from being torn from the door jamb. In one embodiment of the invention, the keeper is slidably mounted for movement toward and away from the mounting bracket. In a second embodiment the keeper is swingably mounted to the mounting bracket.

15 Claims, 8 Drawing Figures

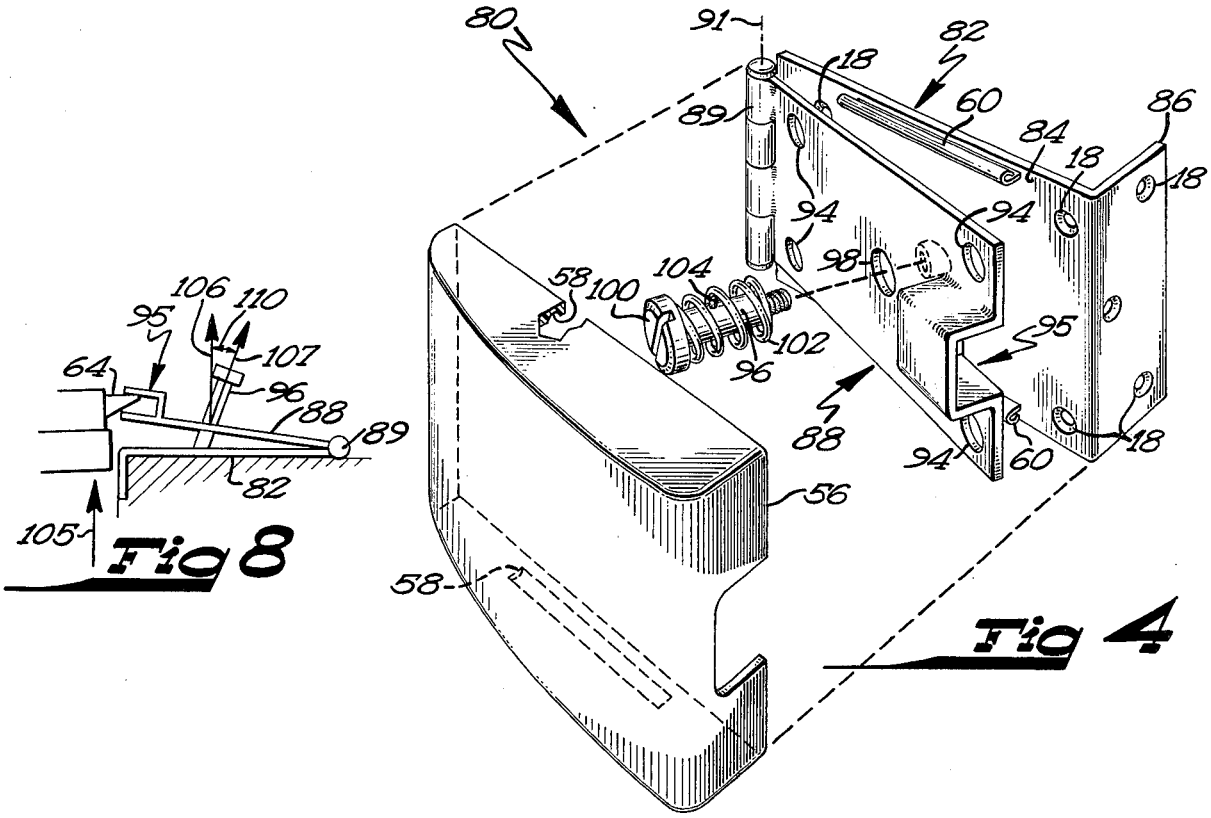
Fig 4
Fig 8
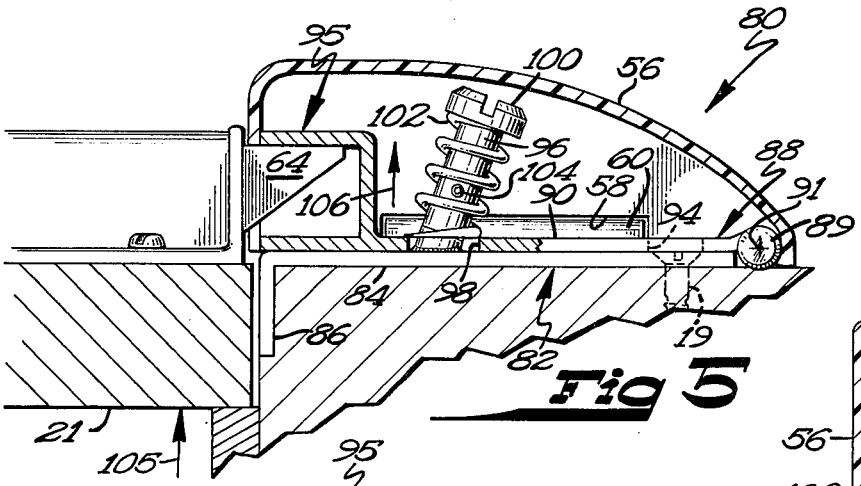
Fig 5
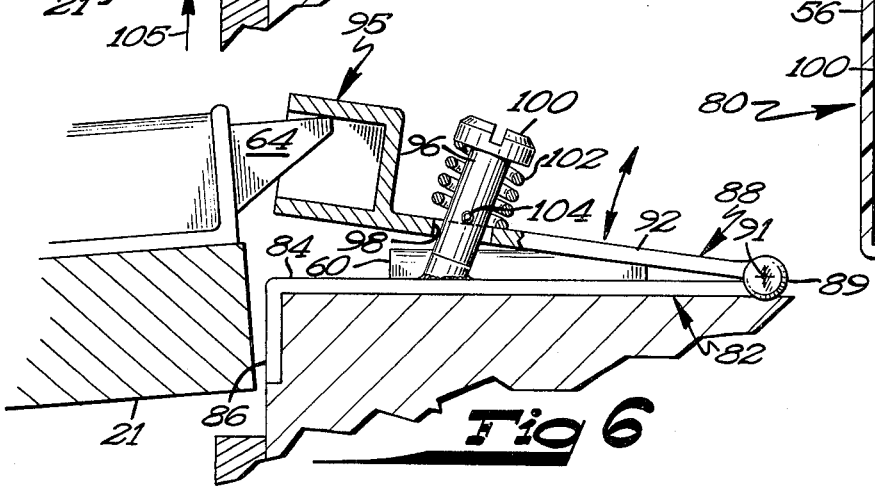
Fig 6
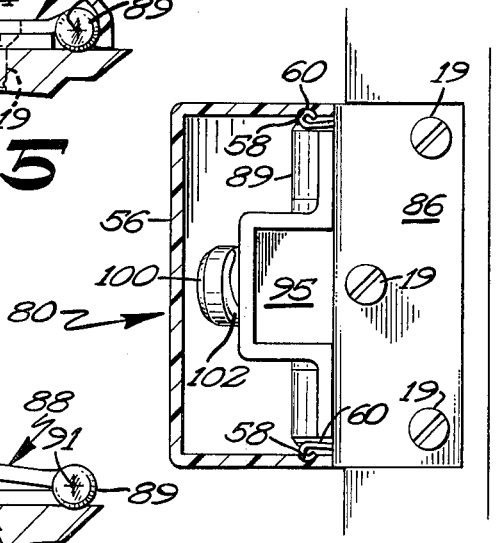
Fig 7

IMPACT ABSORBING LOCK APPARATUS

BACKGROUND OF THE INVENTION

The invention relates to the field of locks and comprises an impact absorbing lock apparatus which prevents unauthorized entry by absorbing the sudden impulse forces applied to a lock when the door is suddenly rammed or kicked, thereby preventing the lock from being torn from the door jamb or door and preventing entry.

Most commercially available locks are attached to door jambs and doors by wood screws and generally depend on such screws to retain them on the door or door jamb. A common means used by trespassers for gaining entry to locked buildings is to deliver a fast, hard kick to a door adjacent the lock. Such a kick applies a high-magnitude force of short duration, often called an impulse force, which is highly effective in tearing or ripping the lock and its supporting screws from the door or jamb even though the same force, applied more gradually, would not break loose the lock. The present invention provides a simple, but highly reliable apparatus which absorbs such impulse forces to prevent dislodging of the lock and unauthorized entry by most kicking or ramming of the door.

SUMMARY OF THE INVENTION

The invention comprises an impact absorbing lock apparatus which is usable as either original equipment on new lock installations or can replace the existing keeper units on most already installed locks. The invention utilizes a mounting bracket which is attachable to the door jamb adjacent and confronting the latch bolt. A keeper is movably mounted relative to the mounting bracket to move between a rest position contacting the mounting bracket and a displaced position. Impact absorbing means such as a spring is provided to urge the keeper toward the rest position and to resist movement of the keeper away from the mounting bracket. Accordingly, a sharp impact applied to the keeper moves the keeper and compresses the spring, resulting in the spring temporarily storing the energy of the impact as the keeper moves to the displaced position, permitting the lock apparatus to yieldedly move in response to the impulse force rather than being torn from the door jamb. The spring releases its energy by returning the keeper to the rest position contacting the mounting bracket.

The keeper may be movably mounted to the mounting bracket by means of a pair of generally parallel rods extending outwardly from and fixed relative to the mounting bracket, the keeper being slidably mounted on the rods and biased to the rest position by one or more springs positioned on the rods. A second embodiment of the invention has the keeper pivotally mounted to the mounting bracket by means of a hinge to permit the keeper to pivot about an axis passing through the hinge. The apparatus is provided with a cover which dislodges from the mounting bracket any time the door is kicked to indicate that an attempt has been made to force the door.

Accordingly, the invention results in an apparatus which protects the door and lock from breakage due to impulse forces. The lock apparatus provides a simple, efficient, easy to manufacture apparatus which is durable, long lasting and relatively inexpensive to manufacture. These and other advantages of the invention will appear from the following drawings and detailed description.

BREIF DESCRIPTION OF THE DRAWING

FIG. 4 is an exploded perspective view of a second embodiment of the invention.

FIG. 5 is a top elevation view of the invention shown in FIG. 4 wherein a latch bolt engages the keeper which is shown in rest position.

FIG. 6 is a top elevation view of the embodiment of FIG. 5 showing the keeper in displaced position.

FIG. 7 is a side elevation view of the lock apparatus of FIG. 4 with the keeper in rest position and with the cover in place.

FIG. 8 is a side elevation view of the locking apparatus of FIG. 5 diagrammatically showing the force components as an impulse force is applied to the keeper during kicking of the door.

DESCRIPTION OF THE PREFERRED EMBODIMENTS

Figures 1, 2, 3:
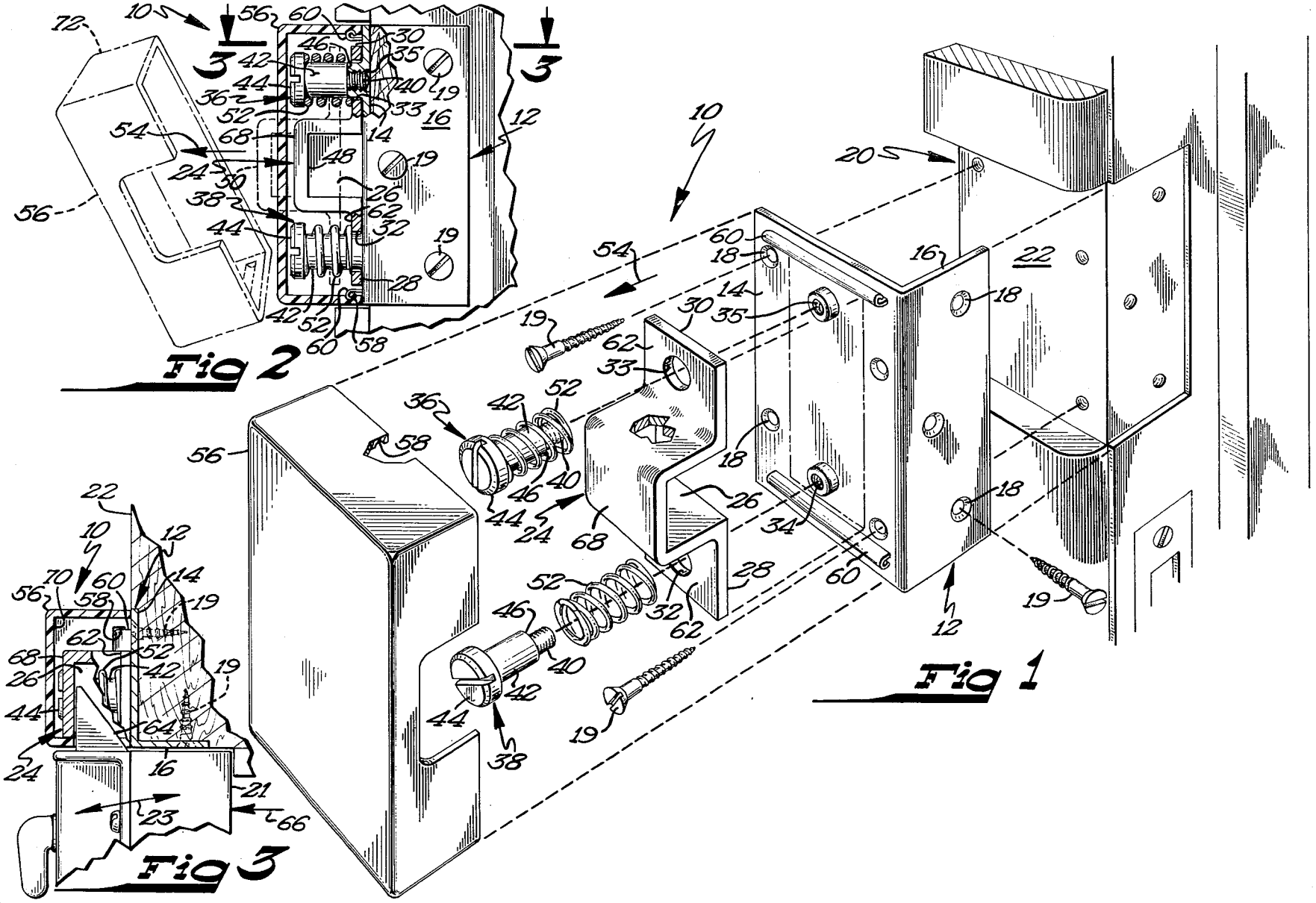
FIG. 1 is an exploded perspective view of an embodiment of the lock apparatus invention showing the mounting of the invention on a standard door jamb.
FIG. 2 is a side elevation view of the embodiment of the invention shown in FIG. 1 showing the displaced positions of the keeper and cover in phantom.
FIG. 3 is a top elevation sectional view of the embodiment of the invention shown in FIG. 1 and taken along cutting plane 3—3 showing the apparatus engaging a latch bolt.

Referring now to FIGS. 1–3 of the drawings, an impact absorbing lock apparatus 10, embodying the invention, has a rigid metal mounting bracket 12 provided with a generally rectangular face plate 14 and reinforcement flange 16 at a right angle to the plate. The bracket 12 is provided with a plurality of screw apertures 18, preferably countersunk, through which screws 19 are threaded into cut-away portion 20 of the door jamb 22. The screw 19 used for attachment should be reasonably long and strong in construction so as to rigidly anchor the mounting bracket 12 to the door jamb 22 and to thereby strongly resist any effort at dislodging the bracket. In the shown orientation of the mounting bracket 12 on the door jamb 22, the apparatus 10 will receive and retain the latch bolt 64 of a conventional dead bolt or night latch, as will be further described hereafter.

A rigid, metal keeper 24 has a latch bolt receiver 26 and a pair of outwardly extending guides 28 and 30 with guide apertures 32 and 33, respectively, which are positioned and spaced to be concentric with and communicate with apertures 34 and 35, respectively, of the mounting plate 12 when the keeper contacts the plate 12. The diameter of the guide apertures 32 and 33 is larger than the diameter of apertures 34 and 35 for reasons described hereafter.

A pair of substantially identical screws 36 and 38 have threaded shanks 40 with diameters which pass loosely through apertures 32, 33, 34 and 35 and screw firmly into the door jamb 22. Each of the screws 36 and 38 is provided with a smooth exterior shoulder 42 having a diameter greater than the shanks 40 and terminating in a generally flattened outwardly extending head 44. The diameter of the shoulders 42 and the diameter of the guide apertures 32 and 33 of keeper 24 are sized appropriately so that the guide apertures 32 and 33 will slide freely along the shoulder 42 in response to urging by the springs 52, described hereafter. Accordingly, when the screws 36 and 38 are in operating position, the threaded shanks 40 firmly engage the door jamb 22, and the radial, leading edges 46 of the shoulders 42 tightly engage the mounting bracket 12, the shoulders 42 of screws 36 and 38 defining substantially parallel first and second guide rods along which guide apertures 32 and 33 of guides 28 and 30, respectively, are slidable. Accordingly, when the screws 36 and 38 are in the described operating position with radial edges 46 contacting plate 14, they cooperate to define a means for mounting the keeper 24 for movement relative to the mounting bracket 12 and permitting the keeper to move along a path between a rest position 48 (FIG. 2), contacting the mounting bracket 12 and a displaced position 50 wherein the keeper 24 is spaced from the mounting bracket.

While the first and second guide rods have been here shown as defined by the shoulders of screws 36 and 38, each of which has a threaded shank 40 engaging the door jamb, it should be understood that the threaded shanks 40 may be eliminated and the screws 36 and 38 instead welded rigidly to the bracket 12 at the general location of the leading edges 46 or attached thereto in other known ways, and variations and modifications in the means of attachment of the guide rods to the bracket or door jamb as would be known to those skilled in the art are within the purview of the invention.

A rigid coil spring 52 is positioned coaxially on the shoulder 42 of each of the screws 36 and 38. The spring 52 is retained in the screw 36 between the head 44 and the guide 30 of keeper 24. The remaining spring 52 is retained on the screw 38 between its head 44 and the guide flange 28 of keeper 24. The springs 52 comprise spring means and should be relatively strong springs highly resistant to compression so as to require a substantial impact force applied to the door 21 in order to compress them, as will be further described hereafter.

The springs 52 when in the described position provide an impact absorbing means to resist movement of the keeper 24 in direction 54 toward displaced position 50 and urge the keeper toward the rest position 48 closely adjacent the plate 14 of bracket 12. While the springs 52 have been shown as defining an impact absorbing means, it should be understood that other equivalent springs, spring systems or impact absorbing devices known to the art may be substituted and are within the purview of the invention.

A cover 56 fits over the lock apparatus 10, providing an attractive exterior appearance. The cover is provided with grooves 58 at inner upper and lower edges which engage upper and lower detents 60 on the plate 14 of mounting bracket 12, releasably retaining the cover 56 on the bracket 12. The detents 60 and cooperating grooves 58 provide a retaining means for releasably retaining the cover on the bracket. The cover 56 is constructed to closely surround the keeper 24 when in position on the bracket 12 such that the cover does not contact the keeper 24 when the keeper is in rest position 48. However, the cover is constructed with an overall depth slightly greater than that of the keeper such that when the keeper is moved to displaced position 50, the surface 68 of the keeper strikes the inside of the cover and dislodges it from the bracket 12, causing the cover to drop from the lock apparatus, thus providing an indication that an attempt has been made to force the lock.

In operation, the lock apparatus 10 is installed by firmly attaching the mounting bracket 12 to the door jamb 22 by means of screws 19 passed through the apertures 18 on both the face plate 14 and reinforcing flange 16. The bracket 12 is mounted in a position adjacent to and confronting the latch bolt 64 of a commercially available lock device having a dead bolt, night latch or other appropriate latch bolt. The keeper 24 is mounted on the face plate 14 of the mounting bracket 12 by means of the generally parallel guide rods 36 and 38 which have shoulders 42 passing freely through the guide apertures 32 and 33 of the keeper, permitting free sliding movement of the guides 28 and 30 of keeper 24 along the shoulders. The springs 52 are positioned on the shoulders and are pretensioned between the heads 44 and the upper surface 62 of the guides when the screws 40 are fully engaged in the door jamb 22 with the leading edges 46 of the shoulders 42 flushly engaging the mounting bracket 12. The cover 56 is snapped into position on the bracket 12 with the grooves 58 engaging the detents 60 to releasably retain the cover 56 on the mounting bracket 12. The door 21 may now be closed and the conventional latch bolt 64 permitted to drop into the latch bolt receiver 26 of the keeper 24 to lock the door 21 in a conventional manner. The stressed springs 52 retain the keeper 24 in firm engagement against the face plate 14 of the bracket 12 in the rest position 48. This position is maintained until a force is applied to the door and to the lock apparatus 10.

If an impulse force or other force 66 is applied to the door 21 and accordingly applied to the keeper 24 through the latch bolt 64, the force 66 moves the door 21 and keeper 24 in the direction 54, causing the guide apertures 33 in the guides 28 and 30 to slide along the shoulders 42 of the rods 38 and 36, respectively, resulting in the keeper moving to a displaced position 50 and the springs 52 being displaced. As the springs 52 are compressed, they absorb or store substantial amounts of the energy of the impulse force 66 as the door 21 swings in the direction 54, thus momentarily storing a substantial amount of the energy of the impulse force and minimizing the tendency of such force to rip the lock apparatus 10 from the door jamb 22. As the force 66 is stored by the springs, the compressed springs 52 move the keeper 24 from the displaced position 50 back to the rest position 48, carrying the bolt 64 and door 21 back to their initial positions.

As the keeper 24 moves in the direction 54, its surface 68 strikes inside 70 of the cover 56 and forces the grooves 58 of the cover to slip from the detents 60 on the bracket 12, resulting in the cover 56 being displaced to position 72 as it drops to the floor to indicate that an attempt has been made to force the lock. The user may later pick up the cover 56 and replace it in position by urging the grooves 58 back into contact with the detents 60.

Accordingly, the embodiment 10 of the invention provides an apparatus by which a substantial impulse force may be prevented from destroying the lock apparatus and thereby protects against unauthorized entry by kicking or ramming of the door 21.

Referring now to FIGS. 4–7, a second embodiment 80 of the impact absorbing lock apparatus is shown. The apparatus 80 has a rigid initial mounting bracket 82 having a face plate 84 and a reinforcing flange 86 at a right angle to the plate. Like the mounting plate 12 of FIG. 1, the plate 84 is also provided with upper and lower detents 60 and a plurality of countersunk screw apertures 18 through which the screws 19 extend into the the door jamb 22 to firmly secure the mounting bracket 82 to the door jamb.

At one edge of the mounting bracket 82 a hinge 89 is rigidly fixed to the plate 84 or integral therewith and also fixed to a keeper 88, the hinge providing a means for mounting the keeper 88 for movement relative to the mounting bracket about an axis 91 and permitting the keeper to move along a path between the rest position 90 (FIG. 5) wherein the keeper is closely adjacent the mounting bracket and a displaced position 92 (FIG. 6).

The keeper 88 is also formed of a rigid metal and has a latch bolt receiver 95 integral therewith. The keeper 88 is provided with a plurality of apertures 94 which are concentric with and communicate directly with the apertures 18 of the face plate 84 when the keeper is in rest position 90, the apertures 94 being of large enough diameter to permit the heads of the screws 19 to pass through the apertures 94, thereby permitting easier mounting of the screws 19 to retain the bracket 82. The keeper 88 is constructed such that when in rest position 90 it nests between the detents 60.

A rigid metal post 96 passes through post aperture 98 in the keeper 88 and is rigidly fixed relative to the mounting bracket 82. The post 96 has a sturdy head 100 at the outer end thereof and confined between the head 100 and the keeper 88 is a rigid spring means such as coil spring 102. The spring 102 is constructed such that it is stressed to retain the keeper 88 in rest position 90 closely adjacent the bracket 82 during normal operation of the door 21, but to be compressable in response to an impulse force applied to the door and keeper to absorb such force, as will be described further hereafter. Accordingly, the post 96 and the spring 102 cooperate to define an impact absorbing means which contacts the keeper and resists movement of the keeper from the rest position 90 to the displaced position 92 and which urges the keeper toward the rest position and briefly absorbs or stores the energy of the impulse force applied to the keeper. Although the post 96 has been shown as being rigidly fixed to the bracket 82, it should be understood that the post may have a threaded end which may be screwed deeply into the door jamb 22, such a modification being within the purview of the invention.

If desired, a stop 104 may be positioned along and fixed to the post 96 in order to limit movement of the keeper along the post 96. The diameter of the stop 104 is less than the inner diameter of the spring 102 but greater than post aperture 98 and assures that the spring 102 is substantially unobstructed during its compressing and expanding movement. Preferably, the stop 104 is angled on the post 96 in order to flushly contact the outer face of the keeper as it swings against the stop.

If desired, the post 96 may be attached to the bracket 82 or screwed into the door jamb at an acute angle 110 to the path of the keeper 88, as best shown in FIGS. 5 and 8 where the path of the keeper as it initially leaves the rest position 90 is substantially vertical to the plate 84. Accordingly, when an impulse force 105 is applied to the door 21, it is transferred to the keeper 88 and applied in the direction 106. Referring now to FIG. 8, the force 106 has a force component 107 directed along the axis of post 96, the component 107, by necessity being of lower magnitude than the force 106. Accordingly, by angling the post 96 at the acute angle 110, a reduced force is applied in the axial direction along the post to compress the spring 102. As a result, the apparatus 80 by having the angled post 96 can handle and withstand a larger magnitude force 106 than would be the case if the post 96 simply lay along the path of the keeper 88 as the keeper moves from rest to displaced positions.

A cover 56 has upper and lower grooves 58 which cooperate and engage the detents 60 on the mounting bracket 82 to releasably retain the cover 56 to the bracket 82. As best shown in FIG. 5, the cover 56 closely surrounding the latch bolt receiver 95 of the keeper so that when the keeper swings from rest position 90 to displaced position 92 the receiver 95 strikes the cover 56, urging the detents 60 from the grooves 58 and causing the cover 56 to be dislodged from the apparatus 80. Accordingly, an observer finding the dislodged cover 56 will know that an attempt has been made to force the lock.

In operation, the mounting bracket 82 is attached to the door jamb 22 by means of screws 19, passed through the communicating apertures 94 and 18, and also through the apertures 18 of the reinforcing plate 86. The installation can be easily accomplished when the keeper 88 is in rest position because the apertures 94 are of a size large enough to permit the heads of the screws 19 to pass through the apertures 94 and into the countersunk bores 18 of the bracket 82.

After the mounting bracket has been rigidly attached to the door jamb 22 with the latch bolt receiver 95 adjacent to and confronting the latch bolt 64 extending outward from a conventional night latch mounted on the door 21, the lock apparatus 80 is ready for operation.

During normal operation, when no impulse forces are applied to the door 21 or the lock apparatus 80, the spring 102 exerts a substantial force against the keeper 88, causing the keeper to remain in flush engagement against the plate 84 of the mounting bracket and to retain the latch bolt 64 in the receiver 95 as any commercially available keeper functions. The cover 56 normally covers the keeper 88 and its grooves 58 engage the detents 60 of the mounting bracket to retain the cover on the bracket.

When an impulse force 105 is applied to the door 21 by an intruder kicking the door or ramming it, the force is transferred to and applied to the keeper 88, as indicated by force 106 (FIGS. 5 and 8). Application of the force 106 causes the keeper to swing about the axis 91 of the hinge 89 from the rest position 90 toward the displaced position 92, wherein the keeper contacts the stop and has substantially compressed the spring 102. By compressing the spring 102, much of the energy of the impulse force 105 is transferred to and stored by the spring, which then exerts a restoring force urging the keeper back to the rest position 90. By having the post 96 acutely angled as shown in the drawings, force component 107 of the force 106 is applied axially along the post 96 and is less than the magnitude of the force 106; accordingly, angling the post makes the apparatus operate more efficiently and makes it possible for it to handle a larger impact force.

As the keeper moves away from the rest position, when the impulse force is applied the latch bolt receiver 95 strikes the inside surface of the cover 56 and causes the cover to become dislodged from the detents 60 of the mounting bracket, resulting in the cover falling from the apparatus 80. By noting that the cover is no longer in place on the apparatus, an observer will know that an attempt has been made to force the lock.

While the preferred embodiment of the present invention have been described, it should be understood that various chages, adaptations and modifications may be made therein without departing from the spirit of the invention and the scope of the appended claims.

What is claimed is:

1. An impact absorbing lock apparatus usable with the latch bolt of a swingable door and mountable on a door jamb to protect against an impulse force applied to the door to force open the door, comprising:

a mounting bracket attachable to the door jamb adjacent the latch bolt;

a keeper capable of retaining the latch bolt;

means mounting said keeper for movement relative to said mounting bracket, permitting said keeper to move along a path between a rest position closely adjacent said mounting bracket and a displaced position;

impact absorbing means resisting movement of said keeper from said rest position to said displaced position and urging said keeper from said displaced position to said rest position to thereby absorb impulse forces applied to the door and the keeper; and said means mounting said keeper for movement including a first guide rod extending outwardly from and fixed relative to said mounting bracket, said keeper being slidably mounted on said guide rod.

2. The impact absorbing lock apparatus of claim 1 wherein said impact absorbing means includes spring means on said first guide rod to resist movement of said keeper from said rest position and to urge said keeper toward said mounting bracket, said spring means storing energy obtained from impulse forces applied to the keeper and thereby minimizing the tendency of such forces to rip the lock apparatus from the door jamb.

3. The impact absorbing lock apparatus of claim 1 wherein said means mounting said keeper for movement includes a second guide rod extending from and fixed relative to said mounting bracket and being substantially parallel to said first guide rod.

4. An impact absorbing lock apparatus usable with the latch bolt of a swingable door and mountable on a door jamb to protect against an impulse force applied to the door to force open the door, comprising:

a mounting bracket attachable to the door jamb adjacent the latch bolt;

a keeper capable of retaining the latch bolt;

means mounting said keeper for movement relative to said mounting bracket, permitting said keeper to move along a path between a rest position closely adjacent said mounting bracket and a disposed position;

impact absorbing means contacting said keeper and resisting movement of said keeper from said rest position to said displaced position and urging said keeper from said displaced position to said rest position to thereby absorb impulse forces applied to the door and the keeper;

said means mounting said keeper for movement being a hinge interconnecting said mounting bracket and said keeper to permit swinging movement of said keeper about an axis; and said impact absorbing means including a post fixed relative to said mounting bracket and extending outwardly from said mounting bracket at an angle acute to said path of said keeper and further including spring means positioned on said post, the angled post receiving a force component of lesser magnitude than the impulse force when the door is forced and said keeper pivots about said axis.

5. An impact absorbing lock apparatus usable with the latch bolt of a swingable door and mountable on a door jamb to protect against an impulse force applied to the door to force open the door, comprising:

a mounting bracket attachable to the door jamb adjacent the latch bolt;

a keeper capable of retaining the latch bolt;

means mounting said keeper for movement relative to said mounting bracket, permitting said keeper to move along a path between a rest position closely adjacent said mounting bracket and a displaced position;

impact absorbing means resisting movement of said keeper from said rest position to said displaced position and urging said keeper from said displaced position to said rest position to thereby absorb impulse forces applied to the door and the keeper;

a cover;

retaining means on said mounting bracket and on said cover for releasably retaining said cover on said mounting bracket; and said cover closely surrounding said keeper such that movement of said keeper from rest position to displaced position brings said keeper into contact with said cover and dislodges said cover from said bracket to thereby indicate that an attempt has been made to force the lock apparatus.

6. An impact absorbing lock apparatus usable with a swingable door and mountable on a door jamb to protect against an impulse force applied to the door in a direction to force the door from a closed to an open position, comprising:

a latch bolt attachable to the door and movable between locked and unlocked positions;

a mounting bracket attachable to the door jamb adjacent said latch bolt;

a keeper capable of retaining said latch bolt when said latch bolt is in locked position;

means mounting said keeper for movement relative to said mounting bracket and for travel with said bolt when in locked position in the direction of movement of said bolt when an impulse force is applied to said bolt through the door, said keeper continuously retaining said bolt when said bolt is in locked position and being movable along a path between a rest position wherein said keeper is closely adjacent said mounting bracket and a displaced position wherein said keeper is spaced from said mounting bracket, said mounting means carried by said mounting bracket; and impact absorbing means carried by said mounting means and resisting movement of said keeper from said rest position to said displaced position and urging said keeper from said displaced position to said rest position to thereby absorb impulse forces applied to the door, said bolt, and said keeper.

7. The impact absorbing lock apparatus of claim 5 wherein said retaining means includes a pair of detents on said mounting bracket releasably engaging said cover and holding said cover closely adjacent said keeper.

8. The impact absorbing lock apparatus of claim 7 wherein said cover includes a pair of grooves releasably engaging said detents of said retaining means to retain said cover adjacent said keeper until movement of said keeper to displaced position dislodges said grooves from said detents.

9. The impact absorbing lock apparatus of claim 4 and further including a stop on said post to limit movement of said keeper along said post.

10. The impact absorbing lock apparatus of claim 4 wherein said spring contacts said keeper and said post has a head spaced from said mounting bracket to confine said spring on said post between said head and said keeper.

11. The impact absorbing lock apparatus of claim 4 and further including:

a cover;

retaining means on said mounting bracket and on said cover for releasably retaining said cover on said mounting bracket; and said cover closely surrounding said keeper such that movement of said keeper from rest position to displaced position brings said keeper into contact with said cover and dislodges said cover from said bracket to thereby indicate that an attempt has been made to force the lock apparatus.

12. The impact absorbing lock apparatus of claim 2 wherein said impact absorbing means includes spring means on said second guide rod to resist movement of said keeper from said rest position and to urge said keeper toward said mounting bracket.

13. The impact absorbing lock apparatus of claim 12 wherein said first and second posts each has an enlarged head therealong to confine said spring means between said keeper and said heads.

14. The impact absorbing lock apparatus of claim 13 and further including:

a cover;

retaining means on said mounting bracket and on said cover for releasably retaining said cover on said mounting bracket; and said cover closely surrounding said keeper such that movement of said keeper from rest position to displaced position brings said keeper into contact with said cover and dislodges said cover from said bracket to thereby indicate that an attempt has been made to force the lock apparatus.

15. In combination with a door jamb, a door hinged to said jamb for swinging movement about a vertical door axis between a closed position and an open position, and a latch bolt carried by said door and movable outwardly from said door toward said jamb in a direction generally parallel to a plane defined by the surface of said door, an impact absorbing lock apparatus to protect against an impulse force applied to the door to swing said door about said door axis from a closed to an open position, comprising:

a mounting bracket attached to said door jamb adjacent said latch bolt;

a keeper supported by said mounting bracket and encompassing said bolt;

means mounting said keeper for movement relative to said mounting bracket in the direction of the impulse force applied to the door to force the door from closed to open position, permitting said keeper to move along a path initially perpendicular to said plane of said door when said door is in closed position, said keeper moving between a rest position closely adjacent said mounting bracket and a displaced position spaced from said mounting bracket while retaining the bolt during such movement of such keeper; and impact absorbing means contacting said keeper and resisting movement of said keeper from said rest position to said displaced position and said keeper continuously retaining said latch bolt as said impact absorbing means urge said keeper from said displaced position to said rest position to thereby absorb impulse forces applied to the door and said keeper.

* * * * *

UNITED STATES PATENT AND TRADEMARK OFFICE

CERTIFICATE OF CORRECTION

PATENT NO. : 4,076,294

DATED : February 28, 1978

INVENTOR(S) : BRADLEY C. HOLMBERG

It is certified that error appears in the above-identified patent and that said Letters Patent are hereby corrected as shown below:

Column 6, line 10, change "surrounding" to --surrounds--.

Column 6, line 49, add the number --104-- after the word "stop".

In claim 4, line 11, delete "disposed" and substitute --displaced--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*